United States Patent [19]

Hutchison

[11] 4,385,664

[45] May 31, 1983

[54] FRANGIBLE CUP THERMAL PACKER ASSEMBLY FOR CASED WELLS

[75] Inventor: Stanley O. Hutchison, Bakersfield, Calif.

[73] Assignee: Chevron Research Company, San Francisco, Calif.

[21] Appl. No.: 289,549

[22] Filed: Aug. 3, 1981

[51] Int. Cl.[3] ..... E21B 33/126; E21B 33/129

[52] U.S. Cl. ..... 166/382; 166/120; 166/131; 166/138; 166/212

[58] Field of Search ..... 166/120, 131, 138, 202, 166/212, 216, 217, 382, 387, 378

[56] References Cited

U.S. PATENT DOCUMENTS

| | | | |
|---|---|---|---|
| 3,011,557 | 12/1961 | Conrad | 166/120 X |
| 3,180,419 | 4/1965 | Cochran et al. | 166/120 |
| 3,211,233 | 10/1965 | Brown | 166/216 |
| 3,339,637 | 9/1967 | Holden | 166/131 X |
| 3,361,207 | 1/1968 | Chenoweth | 166/120 |
| 4,345,649 | 8/1982 | Baugh et al. | 166/120 |

*Primary Examiner*—Stephen J. Novosad
*Assistant Examiner*—Joseph Falk
*Attorney, Agent, or Firm*—G. W. Wasson; Edward K. Keeling

[57] ABSTRACT

A subsurface wellbore completion assembly for a cased well is disclosed. The assembly includes thermal cup packers which may be set at a subsurface location along the well above a hot fluid injection zone. The assembly is run into the well on a tubing string and, at the desired depth, the assembly is converted to operating condition where the packers and slips are set. The apparatus may be reassembled to running condition for withdrawal from the well or the packers may be drilled-over to permit washover in the well.

13 Claims, 11 Drawing Figures

FRANGIBLE CUP THERMAL PACKER ASSEMBLY FOR CASED WELLS

This invention relates to a subsurface completion assembly for use in a wellbore and more particularly to a thermal packer assembly, including frangible thermal cups and a means for setting the packer assembly within a wellbore.

BACKGROUND OF THE INVENTION

Prior Art

In the production of petroleum crude from subsurface formations containing highly viscous crude, it has become the practice to inject into the formation a steam or hot fluid for the purpose of increasing the temperature of the formation, thus increasing the mobility of the crude so that it may flow from the formation into a producing well. The steam or hot fluid is injected down the wellbore from the earth surface through a cased well which is cemented to the formation and perforated at the location where production is desired. After the casing has been placed in the well and the perforations have been completed, it is necessary to run a packing means into the well to seal the annulus above the producing zone from the production or injection zone so as to insure that the hot or steam fluids are directed into the well. Inflatable packers are known that can be transported down the cased well and self-setting slip-type steam packers are known as for instance in the form shown in U.S. Pat. No. 3,485,297, issued to W. N. Sutliff et al on December 23, 1969 for "Automatic Self-Setting Slip-Type Steam Packer." Inflatable packers are known and available from Lynes Inc., P.O. Box 12486, Houston, Tex. 77017.

SUMMARY OF THE INVENTION

In accordance with the present invention, a fluid operated frangible cup thermal packer assembly is produced as a complete assembly to be run on the end of a tubing string and to be placed in the wellbore at depth where injection of hot fluids is to be accomplished. The assembly is run into the well with several elements connected together in a manner to permit the assembly to be easily maneuvered into the well. Once in place, a reverse rotation of the tubing string accomplishes a release of the running assembly and permits the packer to be operated into a working packing arrangement.

The assembly can be reassembled into its lock position and withdrawn from the well or, because of the form of the construction of the packer cups, the back-up rings of the packer may be fractured to permit a washover tool to be run into the well in the annulus around the packer assembly.

In operating position, the packer assembly is maintained in engagement with the casing with a pressure of the injection stream being functional against the packers to increase the forced contact with the casing.

The assembly further includes shearable means which permits a portion of the packer assembly to be left in the hole while the tubing string can be released from the packer and withdrawn.

The objects and features of the present invention will be readily apparent to those skilled in the art from the appended drawings and specification illustrating a preferred embodiment wherein:

FIG. 1 is a cross-sectional view, partially in section, of an earth formation having a wellbore in which the frangible cup thermal packer of the present invention is installed.

FIGS. *2a, 2b,* and *2c* are vertical assembly views, partially in section, illustrating the frangible cup thermal packer of the present invention in its running assembly for positioning within a cased well.

Figure 1:
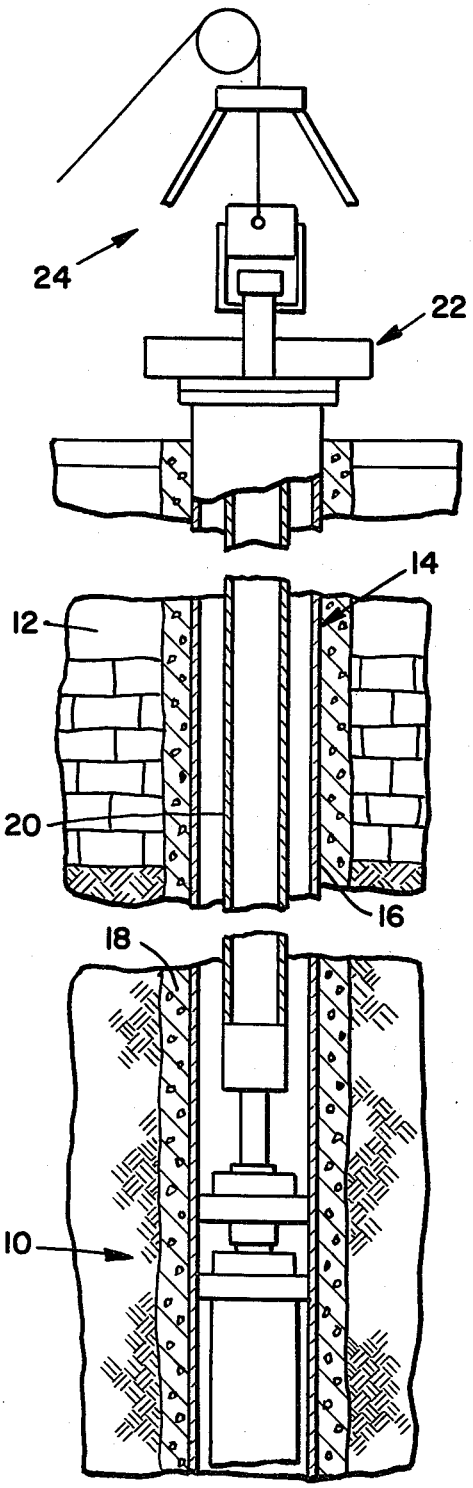

FIG. 1 illustrates the frangible cup thermal packer assembly of the present invention in position in a wellbore penetrating an earth formation. As illustrated, the assembly 10 is located in the petroleum containing formation 12 which is penetrated by a wellbore 14 with a casing 16 cemented to the formation 12 by cementing material 18. An internal tubing string 20 carries the packer assembly 10 into the wellbore and also functions as the conductor tubing for injection of hot fluids or steam into the subsurface formations.

At the earth's surface, the casing 16 is completed with the usual wellhead apparatus 22 which permits the tubing string to be run into and out of the wellbore. For the purposes herein shown, a portion only of a wellhead mechanism 24 is shown in representative form. It being understood that any suitable mechanism may be employed which would permit the running and withdrawal of tubular goods into and out of the wellhead and into the wellbore.

FIGS. *2a, 2b,* and *2c* are assembly views of the frangible cup thermal packer of the present invention. FIG. *2b* connects to the bottom of FIG. *2a,* FIG. *2c* connects to the bottom of FIG. *2b.* It should be understood that the relative dimensions shown in FIGS. *2a, 2b,* and *2c* are slightly inconsistent with the dimensions shown in FIG. 1; however, FIG. 1 is mainly illustrative of how the mechanism would be positioned within the subsurface formation.

As illustrated in FIG. *2a,* the frangible cup thermal packer of the present invention consists of a hollow inner mandrel 30 having a crossover collar 32 at its upper end and a shear ring 34 mounted at its lower end as shown in FIG. *2c.* The crossover collar is connected to the inner mandrel by conventional threaded engagements and the shear ring 34 is connected by a plurality of shear pins 36 passing through the ring and into mating holes 38 in the exterior of the inner mandrel. Near the upper end of the inner mandrel, a circulation port 40 is cut through the wall of the mandrel. At least one port is needed, although several may be provided. The exterior surface of the inner mandrel 30 is reasonably smooth to permit other mechanisms of the assembly to be slideable axially along the inner mandrel.

Surrounding the inner mandrel is a packer cup mandrel assembly along with a middle mandrel member. The packer cup mandrel 42 is cylindrical and surrounds the inner mandrel 30 and includes a set of one or more packer cups 44 positioned between a jam nut collar 46 and a coupling 48, both engaging threads on the packer cup mandrel. The packer cups themselves are an assembly of a spacer 50 engaging a cup seal support ring 52 in contact with the cup 44 and a frangible back-up ring 54 with a metal back-up ring 56. The number of packer cup sets used on the packer cup mandrel is determined by the amount of pressure that the subsurface injection system is to withstand. Each separate packer cup reduces the pressure proportionately along the cased well.

The upper end of the packer cup mandrel is sealed by packing nut 58 which includes a shoulder for compressing a packing material 60 against a shoulder 62 on the inside surface of the packer cup mandrel 42.

Figure 2A:
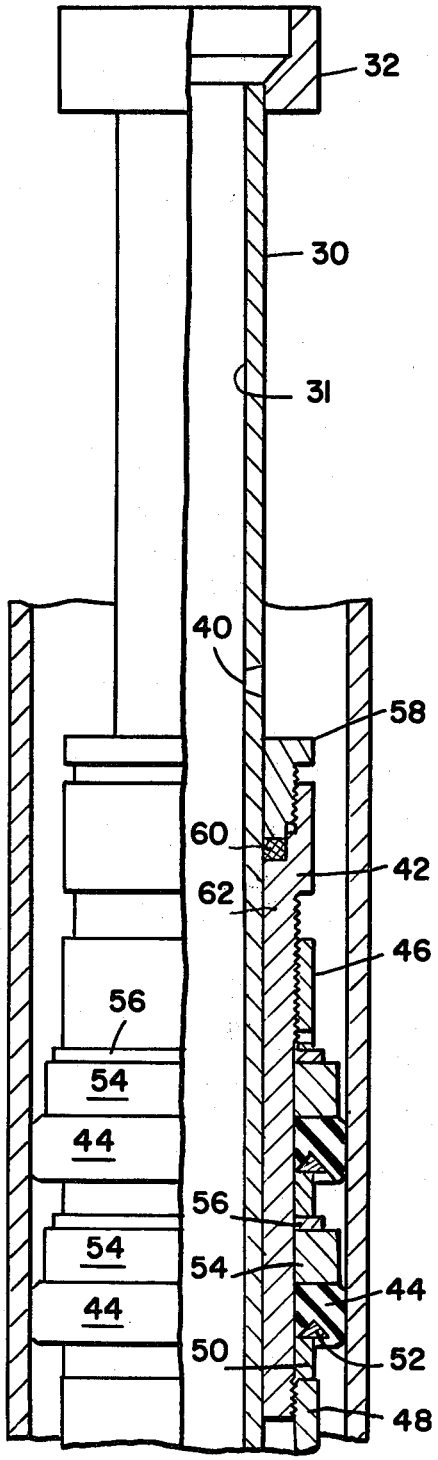
Figure 2B:
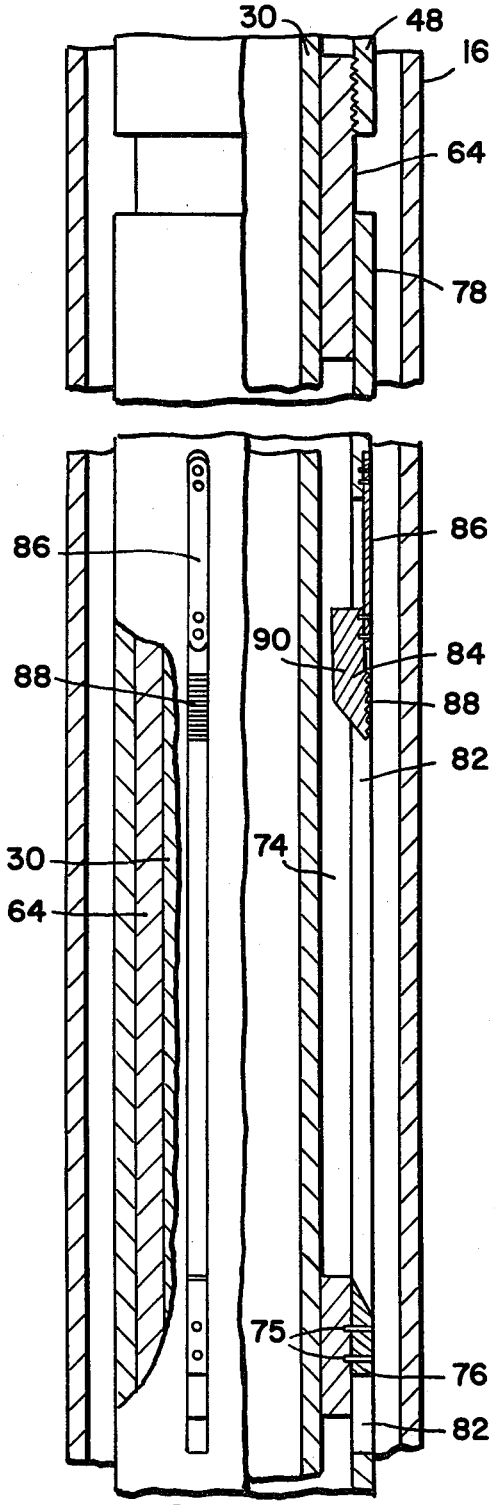
Figure 4:
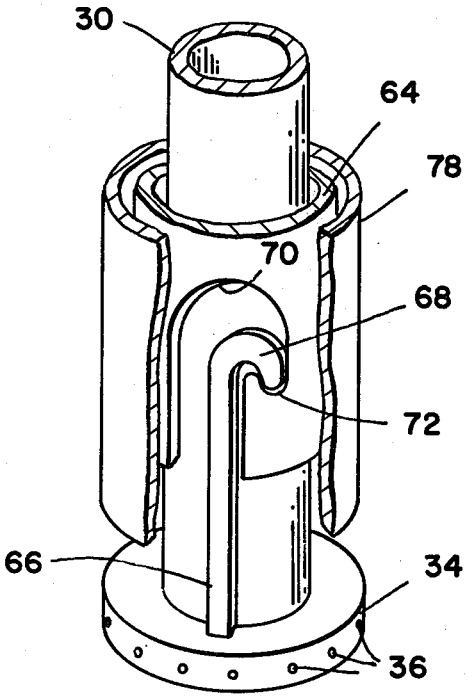
FIG. 4 is a perspective view, partially in section, illustrating a connection between the ring means on the inner mandrel with the middle mandrel.

Also surrounding the inner mandrel, as shown in FIG. 2*b*, is a hollow middle mandrel 64. The upper end of the middle mandrel 64 is externally threaded to engage the coupling 48 to be movable therewith. The lower end of the middle mandrel is connected by releaseable connection means to the shear ring 34. The releaseable connection means herein shown includes a J-projection 66 having a hook portion 68 cooperating with a slot 70 cut into the exterior of the middle mandrel and including a cooperating key-way 72 in the slot. A clear description and illustration of the slot and key-way and J-projection is shown and will be described with reference to FIG. 4. For the purpose of description herein, it should be understood that with the J-projection 66 in contact with the slot and key-way 72, the middle mandrel 64 will be connected to the inner mandrel 30 to be movable therewith.

A plurality of longitudinal slots 74 are cut through the middle mandrel 30 to provide a function to be described hereinafter. At the bottom end of each of these slots and on the exterior surface of the middle mandrel, a like plurality of wedges 76 are secured to the exterior of the mandrel 30.

Surrounding the middle mandrel and slidable with respect thereto, is an outside mandrel 78. The outside mandrel 78 is dimensionally about the length of the middle mandrel and is held in place on the inner mandrel by engagement of the shear ring 34 at its bottom end and by contact at its upper end with the coupling 48 after movement along the middle mandrel. The outside mandrel 78 is provided with a plurality of centralizer springs 80 which engage the inner surface of the cased well 16. A plurality of slots 82 are cut through the exterior surface of the outside mandrel. The slots 82 are aligned with the slots 74 in the middle mandrel and provide a channel through which the wedges 76 may move with respect to the outside mandrel. Near the upper end of the outside mandrel 78, a plurality of slips 84 are mounted by slip retainer springs 86. The exterior surface of the slips 84 are provided with teeth at 88 and the interior surface 90 is aligned and operates within the slots 74 in the middle mandrel 64.

Figure 5:
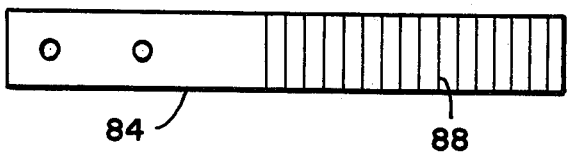
FIG. 5 is an enlarged top view of the slip members for use in the present invention.
Figure 6:
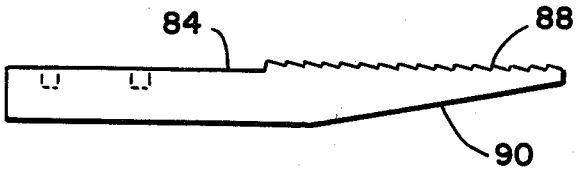
FIG. 6 is a side view of FIG. 5.
Figure 7:
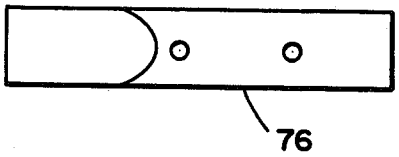
FIG. 7 is an enlarged top view of a wedge surface for use with the present invention.
Figure 8:
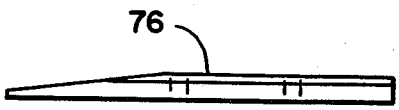
FIG. 8 is a side view of FIG. 7.
Figure 9:
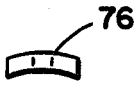
FIG. 9 is an end view of FIG. 8.

Details of the slips 84 and of the wedge surfaces 76 are shown in FIGS. 5 through 9. FIGS. 5 and 6 illustrating the slips and FIGS. 7, 8, and 9 illustrating the wedge 76.

Figure 2C:
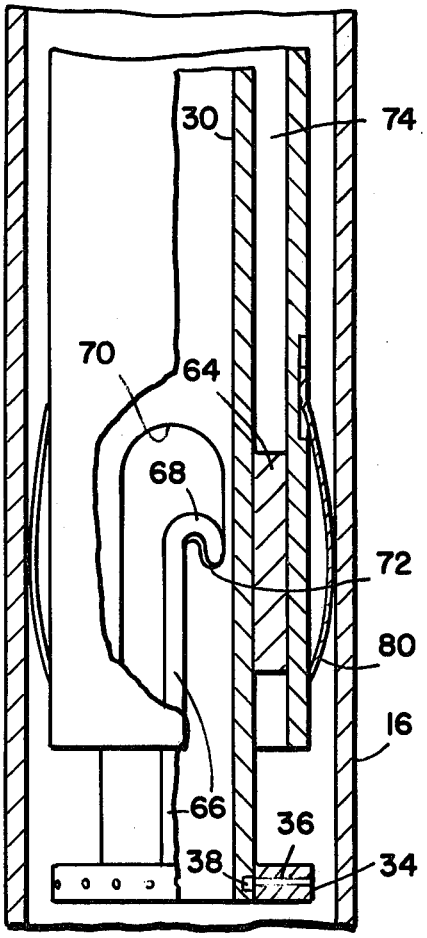

The form of the frangible cup thermal packer assembly, as illustrated in FIGS. 2*a*, 2*b*, and 2*c*, is in the form that the assembly would be when running into the well. When the assembly has been lowered to the desired position within the well, the assembly should be released from its running position and placed in condition for accomplishing the desired packing of the well. In the running condition, circulating port 40 is open and any wellbore fluids may pass upwardly through the inner mandrel and out the circulating port so that the entire assembly can be run into the well. When at depth, the tubing string is lifted slightly to bring the hook portion 68 up out of the key-way 72 in slot 70 and the string is turned slightly to the left, clockwise in the view shown in FIG. 4, to rotate the J-projection within the slot 70 and to permit the hook portion to be released from the key-way. Then as the inner mandrel is lowered, the middle mandrel is released from the inner mandrel and the entire assembly can be run into its packing position.

In the running condition, the outside mandrel is maintained in contact with the casing 16 by the centralizer springs 80 and as the J-slot is released, the outside mandrel remains in its relative position with respect to the casing 16. As the inner mandrel is lowered, the circulating port 40 is moved into the packer cup mandrel 62, at least inside of the packing nut 58 to close off the inner mandrel from the annulus outside of the inner mandrel and above the packing cups. The well may then be pressurized by running pressure down the tubing string and through the inner mandrel, thus pressurizing the well below the packer cup assembly. The packer cups 44 are in engagement with the inside of the casing 16 and, as the lower wellbore is pressurized, these packer cups are further secured against the casing and the packer cup mandrel 42 is forced upwardly on the inner mandrel 30 through the expansion area 31. Any expansion of contraction of the tubing string, caused by increased temperature in the string, will permit the inner mandrel 30 to be movable within the packer cup mandrel 42 while the packer cup maintains its sealing contact with the casing 16.

Figure 3:
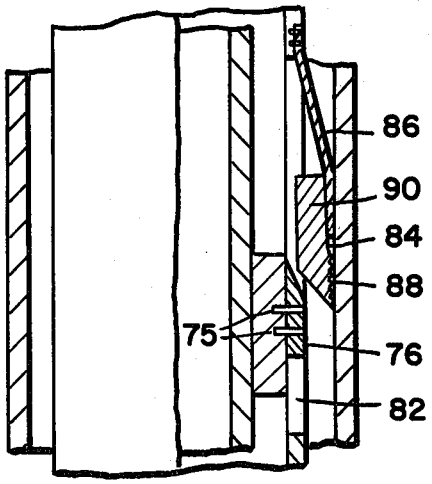
FIG. 3 is a partial sectional view of the slip and wedge mechanism for maintaining the packer assembly in contact with the cased well.

Upward movement of the middle mandrel 64 carries wedge surfaces 76 into contact with slips 84 and forces them into contact with the cased well 16, as shown in FIG. 3. The pressure exerted on the packer cups 44 applies increasing pressure on the wedges 76 against the slips 84 forcing the slips into securing engagement with the casing 16 and thus preventing any further upward movement of the thermal packer assembly in the wellbore.

When it is desired to release the packer assembly from its engagement in the wellbore, the well is unpressurized and the tubing string is lifted with respect to the packer assembly to carry the J-projection 66 and its hook portion 68 into the slot 70 in middle mandrel 64. Rotation of the tubing string 20 to the right, in a counterclockwise direction with respect to the showing of FIG. 4, causes the hook portion 68 to become aligned with the cooperating key-way 72 for a re-engagement of the shear ring 34, on inside mandrel 30, and the middle mandrel 64. Then as the tubing string is lowered, the middle mandrel is carried with the inner mandrel and the wedge surfaces 76 are removed from their engagement with the inside surfaces 90 of the slips 84 and, when completely disengaged, the slips 84 are then pressed backwardly into the longitudinal slots 74 in the middle mandrel 64 to be thus disengaged from the casing 16.

The upward movement of the tubing string 20 has also moved the expansion area 31 out of the packer cup mandrel 42 and has exposed the circulation port 40 beyond the packing nut 58. The entire thermal packer assembly is now released from the casing and may be raised and lowered within the wellbore with any circulating fluids in the wellbore passing through the circulation port 40 and downwardly through the hollow inner mandrel 30.

On some occasions, the packer cup assembly of the type shown herein can become completely locked within the wellbore such that the reconnection of the J-projection and J-slot either cannot be accomplished or, when it is accomplished, it is impossible to move the packer assembly within the wellbore. In that event, the inner mandrel may be released from the entire assembly by forced and rapid upward movement of the inner mandrel to jar the shear ring 34 against the bottom of the outside mandrel 78. That force shears pins 36 and releases the complete engagement of the inner mandrel to the packer assembly. That action may also shear the pins 75 which hold the wedge surfaces 76 to the middle mandrel 64. When thus sheared, the wedges 76 may drop out of the slots 82 in the outer mandrel and the slips 84 may be released from the casing 16.

Should all of these maneuvers fail to release the packer assembly from its engagement in the wellbore, it is still possible to come down the outside of the entire tubing string and to drill around the packer cups 44 and to crush the frangible back-up rings 54 to completely release the packer assembly from its engagement with the wellbore. The string may then be retrieved from the well and refurbished at the surface for reinsertion and repositioning within the wellbore.

While a certain preferred embodiment of the invention has been specifically disclosed, it should be understood that the invention is not limited thereto, as many variations will be readily apparent to those skilled in the art and the invention is to be given its broadest possible interpretation with the terms of the following claims.

I claim:

1. A frangible cup thermal packer assembly for a cased well, comprising:

(a) a hollow inner mandrel having means at its upper end for connection to a well tubing within said cased well and a removably mounted ring at its lower end;

(b) an outside mandrel surrounding said inner mandrel and establishing an annulus between said inner and outer mandrel along at least a portion of said inner mandrel;

(c) a middle mandrel surrounding said inner mandrel and slideably operable within said annulus between said inner and outer mandrels;

(d) means on said ring on said inner mandrel for connecting and disconnecting said middle mandrel to said inner mandrel;

(e) a packer cup mandrel surrounding said inner mandrel and coupled to said middle mandrel and movable therewith;

(f) thermal packer cup means mounted on the exterior surface of said packer cup mandrel, said thermal cup packer means cooperating with said cased well to seal the annulus within said cased well and between said frangible cup thermal packer and said well;

(g) slip means spring mounted to said outside mandrel in position to be engaged with said cased well;

(h) a wedge surface means mounted on said middle mandrel in alignment with said slip means and cooperable therewith to position said slip means in engagement with said cased well;

(i) said inner mandrel being movable relative to said middle mandrel when said means on said ring is disconnected from said outer mandrel, whereby said wedge surface means is moved to position said slip means in engagement with said cased well;

(j) and said packer cup mandrel being movable along said inner mandrel in response to fluid pressure down said inner mandrel and outside said outside mandrel to carry said middle mandrel and said wedge surface means against said slip means;

(k) a circulation port through said inner mandrel adjacent to a portion of said packer cup mandrel;

(l) and internal packing means fixed to said packer cup mandrel and operating between the outside of said inner mandrel and the inside of said packer cup mandrel, said internal packing means closing said circulation port when said inner mandrel is moved with respect to said packer cup mandrel and said middle mandrel.

2. The frangible cup thermal packer of claim 1 wherein said thermal cup packer means includes a frangible back-up ring which will support said thermal cup packer means against said cased well in response to said fluid pressure down said inner mandrel and may be crushed to permit access to said cased well below said thermal cup packer through the annulus between said outer mandrel an said closed well.

3. The apparatus of claim 2 wherein said removably mounted ring on said inner mandrel is mounted by shearable means and shearing of said shearable means permits withdrawal of said inner mandrel from said frangible cup thermal packer along said cased well.

4. The apparatus of claim 1 wherein said outer mandrel is retained on said middle mandrel below said packer cup mandrel and above said removable mounted ring on said inner mandrel.

5. The apparatus of claim 1 wherein said means on said ring for connecting and disconnecting said middle mandrel to said inner mandrel is a mating projection and slot which remains engaged during rotation of said apparatus in one direction about the axis of said cased well and is releaseble from said engagement with rotation of said assembly in the opposite direction accompanied with downward movement of said inner mandrel along said cased well.

6. The apparatus of claim 5 wherein said mating projection and slot are so dimensioned that release of projection from said slot and downward movement of said inner mandrel moves said circulation port into closing position with respect to said packer cup mandrel.

7. The apparatus of claim 6 wherein said movement of said packer cup mandrel carries said middle mandrel and said wedge surface means into contact with said slip means with said cased well.

8. The apparatus of claim 1 wherein said slips means are guided in longitudinal slots within said middle mandrel and said wedge surface means are guided in longitudinal slots in said outside mandrel, said slots in said middle mandrel and outside mandrel being aligned radially with respect to said apparatus.

9. The apparatus of claim 1 wherein said circulation port through said inner mandrel is exposed when said means on said ring is connected to said middle mandrel, said packer cup mandrel being movable axially along said inner mandrel when said means on said ring is disconnected from said middle mandrel to effect said packing means closing of said circulation port.

10. The apparatus of claim 7 wherein said packer cup mandrel is movable along said inner mandrel in response to said fluid pressure down said inner mandrel and outside said outside mandrel.

11. The apparatus of claim 1 wherein said outside mandrel includes centralizer spring means contacting said cased well, said centralizer spring means holding said outside mandrel in contact with said cased well after release of said middle mandrel from said inner mandrel whereby movement of said middle mandrel can move said wedge surface with respect to said slip means.

12. A method placing a frangible cup thermal packer assembly at depth in a cased well, said assembly including:

a hollow inner mandrel, an outside mandrel, a middle mandrel connected to a packer cup mandrel including an external packer cup and an internal packing means, a means on said inner mandrel for connecting and disconnecting said middle mandrel from said inner mandrel, slip means on said outside mandrel, a wedge surface means on said middle mandrel, and a circulation port through said inner mandrel in alignment to be positioned in cooperation with said internal packing means on said packer cup mandrel, the steps of:

(a) connecting said assembly to the end of a well conductor string with said means on said inner mandrel connecting said middle mandrel to said inner mandrel;

(b) running said assembly into a cased well to the depth desired, circulating well fluids through said inner mandrel and out said circulation port;

(c) releasing said connection between said middle mandrel and said inner mandrel;

(d) moving said inner mandrel with respect to said middle mandrel and said packer cup mandrel to close said circulation port with said internal packing means;

(e) pressurizing said well by circulating fluid down said inner mandrel to force said packer cup mandrel upward along said inner mandrel; and (f) moving said wedge surface means with said middle mandrel to move said wedge surface means against said slip means to engage said slip means with said cased well.

13. The method of claim 12 including the step of reconnecting said released connection between said middle mandrel and said inner mandrel by moving said inner mandrel upward in said cased well, said reconnection of said middle mandrel and inner mandrel causing said circulation port to be opened to permit wellbore fluids to circulate between said inner mandrel and said cased well.

* * * * *